US009068438B2

(12) United States Patent
Stibbe et al.

(10) Patent No.: US 9,068,438 B2
(45) Date of Patent: Jun. 30, 2015

(54) OPTIMIZATION OF SAMPLE CLEANUP DURING FORMATION TESTING

(75) Inventors: Holger Stibbe, Humble, TX (US); Russell Mceacharn, Kingwood, TX (US); James T. Cernosek, Missouri City, TX (US); Anthony D. Self, Colfax, LA (US); Avigdor Hetz, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 353 days.

(21) Appl. No.: 13/358,268

(22) Filed: Jan. 25, 2012

(65) Prior Publication Data

US 2013/0019671 A1 Jan. 24, 2013

Related U.S. Application Data

(60) Provisional application No. 61/437,259, filed on Jan. 28, 2011.

(51) Int. Cl.
*E21B 49/08* (2006.01)
*E21B 49/10* (2006.01)

(52) U.S. Cl.
CPC ..... *E21B 49/10* (2013.01); *E21B 49/08* (2013.01); *E21B 49/081* (2013.01)

(58) Field of Classification Search
CPC ..... E21B 49/08; E21B 49/10; E21B 49/081
USPC ..... 73/152.01, 152.23, 152.24
See application file for complete search history.

(56) References Cited

U.S. PATENT DOCUMENTS

| | | | | |
|---|---|---|---|---|
| 5,741,962 | A * | 4/1998 | Birchak et al. | 73/152.16 |
| 6,301,959 | B1 | 10/2001 | Hrametz et al. | |
| 7,196,786 | B2 * | 3/2007 | DiFoggio | 356/301 |
| 2009/0255729 | A1 * | 10/2009 | Georgi et al. | 175/24 |
| 2010/0094312 | A1 * | 4/2010 | Ruiz Morales et al. | 606/130 |

OTHER PUBLICATIONS

Malik, Comparison of Wireline Formation-Tester Sampling with Focused and Conventional Probes in the Presence of Oil-Base Mud-Filtrate Invasion, Manuscript, Oct. 2009, vol. 50, Society of Petrophysics and Well Log Analysts.

* cited by examiner

*Primary Examiner* — Hezron E Williams
*Assistant Examiner* — David Z Huang
(74) *Attorney, Agent, or Firm* — Cantor Colburn LLP

(57) ABSTRACT

Disclosed is a formation testing tool for extracting formation fluid from an earth formation penetrated by a borehole having a drilling fluid. The tool includes: a sample flow element configured to extract formation fluid from the formation in a sample zone; a sample zone seal forming a perimeter defining the sample zone; a contamination removal flow element configured to extract formation fluid contaminated with the drilling fluid from a contamination removal zone in the formation; a contamination removal zone seal forming a perimeter defining the contamination removal zone, which surrounds and excludes the sample zone; and a controller configured to control a sample flow rate in the sample flow element and a contamination removal flow rate in the contamination flow removal element in order to decrease an amount of time required to acquire a sample of the formation fluid having an acceptable amount of contamination.

16 Claims, 5 Drawing Sheets

($Q_s$= sample path flow rate; $Q_g$= contamination removal path flow rate)

OPTIMIZATION OF SAMPLE CLEANUP DURING FORMATION TESTING

CROSS REFERENCE TO RELATED APPLICATIONS

This application claims the benefit of an earlier filing date from U.S. Provisional Application Ser. No. 61/437,259 filed Jan. 28, 2011, the entire disclosure of which is incorporated herein by reference.

BACKGROUND

1. Field of the Invention

The invention disclosed herein relates to sampling formation fluids and, more particularly to clean up of the samples.

2. Description of the Related Art

In the quest for hydrocarbons, boreholes are drilled into geologic formations that may contain reservoirs of the hydrocarbons. Drilling time can be very expensive due to personnel and drilling rig costs. In order to efficiently use drilling resources, samples of formation fluids are obtained from the formations using formation testers disposed in the boreholes. Based on sample tests such as chemical characterization, drilling decisions can be made to efficiently use the drilling resources.

A drilling fluid or mud is typically pumped through a drill string to a drill bit drilling a borehole in order to lubricate the drill bit and flush cuttings from the borehole. The drilling mud is present in the borehole and can enter pores of rock in the borehole wall where the drilling mud is called filtrate. A formation tester is used to extract a sample of formation fluid through the borehole wall. Unfortunately, filtrate can contaminate the sample. In order to minimize contamination, the formation fluid is continuously extracted over a time interval. During the time interval, when the amount of filtrate contamination decreases to an acceptable amount or to near zero and, then, a sample of the formation fluid is taken.

Depending on factors such as the type of rock and filtrate, it may take hours or even days to achieve levels of filtrate that are acceptable for characterization. It would be well received in the drilling industry if the formation testing art could be improved to decrease the amount of time required to obtain a sample of a formation fluid with an acceptable level of mud-filtrate contamination.

BRIEF SUMMARY

Disclosed is a formation testing tool for extracting formation fluid from an earth formation penetrated by a borehole having a drilling fluid, the tool includes: a sample flow element configured to extract formation fluid from the formation in a sample zone; a sample zone seal forming a perimeter defining the sample zone; a contamination removal flow element configured to extract formation fluid contaminated with the drilling fluid from a contamination removal zone in the formation; a contamination removal zone seal forming a perimeter defining the contamination removal zone, which surrounds and excludes the sample zone; and a controller configured to control a sample flow rate in the sample flow element and a contamination removal flow rate in the contamination flow removal element in order to decrease an amount of time required to acquire a sample of the formation fluid having an acceptable amount of contamination.

Also disclosed is a method for extracting formation fluid from an earth formation penetrated by a borehole having a drilling fluid, the method includes: conveying a formation testing tool through the borehole, the tool having: a sample flow element configured to extract formation fluid from the formation in a sample zone; a sample zone seal forming a perimeter defining the sample zone; a contamination removal flow element configured to extract formation fluid contaminated with the drilling fluid from a contamination removal zone in the formation; a contamination removal zone seal forming a perimeter defining the contamination removal zone, which surrounds and excludes the sample zone; and a controller configured to control a sample flow rate in the sample flow element and a contamination removal flow rate in the contamination flow removal element; and controlling the sample flow rate and the contamination removal flow rate in order to decrease an amount of time required to acquire a sample of the formation fluid having an acceptable amount of contamination.

Further disclosed is a non-transitory computer-readable medium having computer-executable instructions for extracting formation fluid from an earth formation penetrated by a borehole having a drilling fluid by implementing a method including: controlling a sample flow rate; and controlling a contamination removal flow rate in order to decrease an amount of time required to acquire a sample of the formation fluid having an acceptable amount of contamination using a formation testing tool having: a sample flow element configured to extract formation fluid from the formation in a sample zone; a sample zone seal forming a perimeter defining the sample zone; a contamination removal flow element configured to extract formation fluid contaminated with the drilling fluid from a contamination removal zone in the formation; a contamination removal zone seal forming a perimeter defining the contamination removal zone, which surrounds and excludes the sample zone; and a controller configured to control the sample flow rate in the sample flow element and the contamination removal flow rate in the contamination flow removal element.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the Figures.

Figure 1:
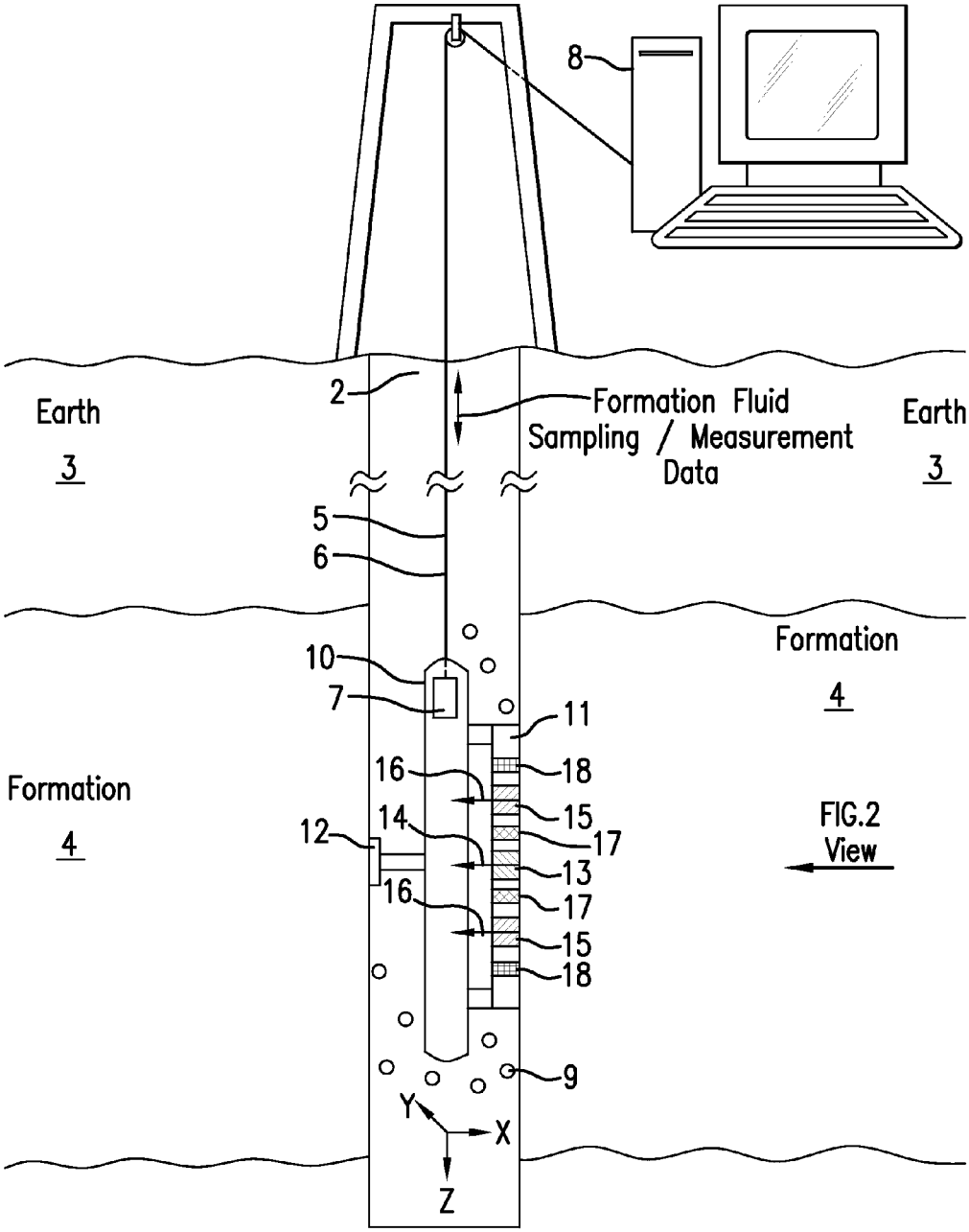
FIG. 1 illustrates an exemplary embodiment of a formation testing tool disposed in a borehole penetrating an earth formation.

FIG. 1 illustrates an exemplary embodiment of a formation testing tool 10 disposed in a borehole 2 penetrating the earth 3, which includes an earth formation 4. While the borehole 2 is depicted in FIG. 1 as having a vertical orientation, the borehole 2 can also be deviated from the vertical orientation.

The borehole 2 contains a drilling fluid (or mud) 9. The formation testing tool 10 is conveyed through the borehole 2 by a carrier 5. In the embodiment of FIG. 1, the carrier 5 is an armored wireline 6. Besides supporting the formation testing tool 10 in the borehole 2, the wireline 6 can also provide communications between the formation testing tool 10 and a computer processing system 8 disposed at the surface of the earth 3. In logging-while-drilling (LWD) or measurement-while-drilling (MWD) embodiments, the carrier 5 can be a drill string. In LWD/MWD embodiments, the formation testing tool 10 can be operated during a temporary halt in drilling. In order to operate the downhole tool 10 and/or provide a communications interface with the surface computer processing system 8, the formation tester tool 10 includes downhole electronics 7.

Still referring to FIG. 1, the formation testing tool 10 includes a fluid sampling pad 11 configured to be extended from the formation testing tool 10 to make contact with the formation 4 at a wall of the borehole 2. In the embodiment of FIG. 1, the fluid sampling pad 11 has a circular cross-section, the plane of which is normal to the plane of FIG. 1. Other shapes of the pad 11 may also be used including shapes that conform to the curvature of the borehole 2. In order to secure the fluid sampling pad 11 to the formation 4 and prevent the pad 11 from pushing the tool 10 away and preventing a seal to the borehole wall, the formation testing tool 10 includes a mechanism 12 configured to secure the formation testing tool 10 in place in the borehole 2.

Still referring to FIG. 1, the fluid sampling pad 11 includes a sample flow element 13 that defines a sample flow path 14 and a contamination removal flow element 15 that define a contamination removal flow path 16. A first seal 17 forms a perimeter around the sample flow path 14 in order to isolate the sample flow path 14 from the contamination removal flow path 16. A second seal 18 forms a perimeter around the contamination removal flow path 16 to isolate the contamination flow path 16 from an area of the formation 4 outside of the perimeter formed by the second seal 18. Hence, the first seal 17 and the second seal 18 define three separate zones—a sample zone within the perimeter formed by the first seal 17, a contamination zone formed within the perimeter of the second seal 18 but excluding the sample zone, and a borehole zone external to the perimeter formed by the second seal 18. In one embodiment, the sample flow element 13 is concentric to the contamination removal flow element 15.

Figure 2:
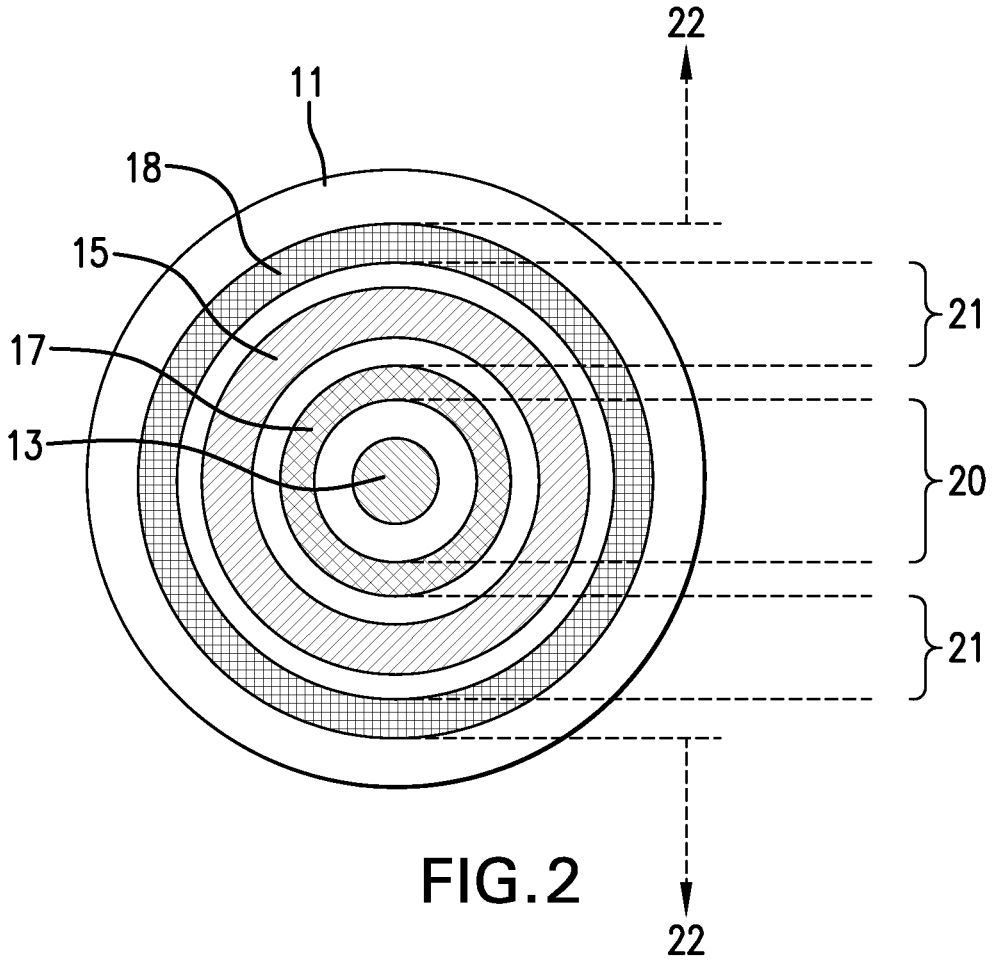
FIG. 2 illustrates aspects of a sample zone, a contamination removal zone, and a borehole zone with respect to the formation testing tool.

FIG. 2 provides an illustration showing a sample zone 20, a contamination removal zone 21 and a borehole zone 22. These three zones are exclusive of each other. As shown in FIG. 2, the contamination removal zone 21 surrounds and excludes the sample zone 20. The sample flow element 13 is configured to retrieve fluid from the sample zone 20 at a sample flow rate. The contamination removal flow element is configured to retrieve fluid from the contamination removal zone 21 at a contamination removal flow rate. The fluid is retrieved by reducing pressure in the corresponding flow element in a zone using a pressure reducing device such as a pump coupled to a flow element. It can be appreciated that one or more sample flow elements 13 can be used to retrieve fluid from the sample zone 20 and one or more contamination removal flow elements 15 can be used to retrieve fluid from the contamination removal zone 21. It can also be appreciated that the sample flow element 13 and the contamination removal flow element 15 can built to assume other shapes such as oval shapes. It can also be appreciated that the sample flow element 13 and the contamination removal flow element 15 can be configured as to be non-concentric to each other.

Before extraction of the formation fluid, the sample zone is considered to be invaded by the drilling mud 9. The term "invaded" relates to the drilling mud 9 being disposed in pores of the formation 4 up to a certain radial distance from the wall of the borehole 2 or forming a coating or covering along the wall of the borehole 2. In one embodiment, when extraction of the formation fluid commences, a concentration of mud-filtrate contamination is about the same in the sample zone 20 as it is in the contamination removal zone 21. As the extraction continues, the concentration of the mud-filtrate contamination in the sample flow path 14 will be less than the concentration of mud-filtrate contamination in the contamination removal flow path 16. This is because all or most mud-filtrate that passes around the second seal 18 through formation rock pores from the borehole zone 22 to the contamination removal zone 21 (due to reduced pressure in the zone 21) will be removed via the contamination removal flow element 15.

Figure 3:
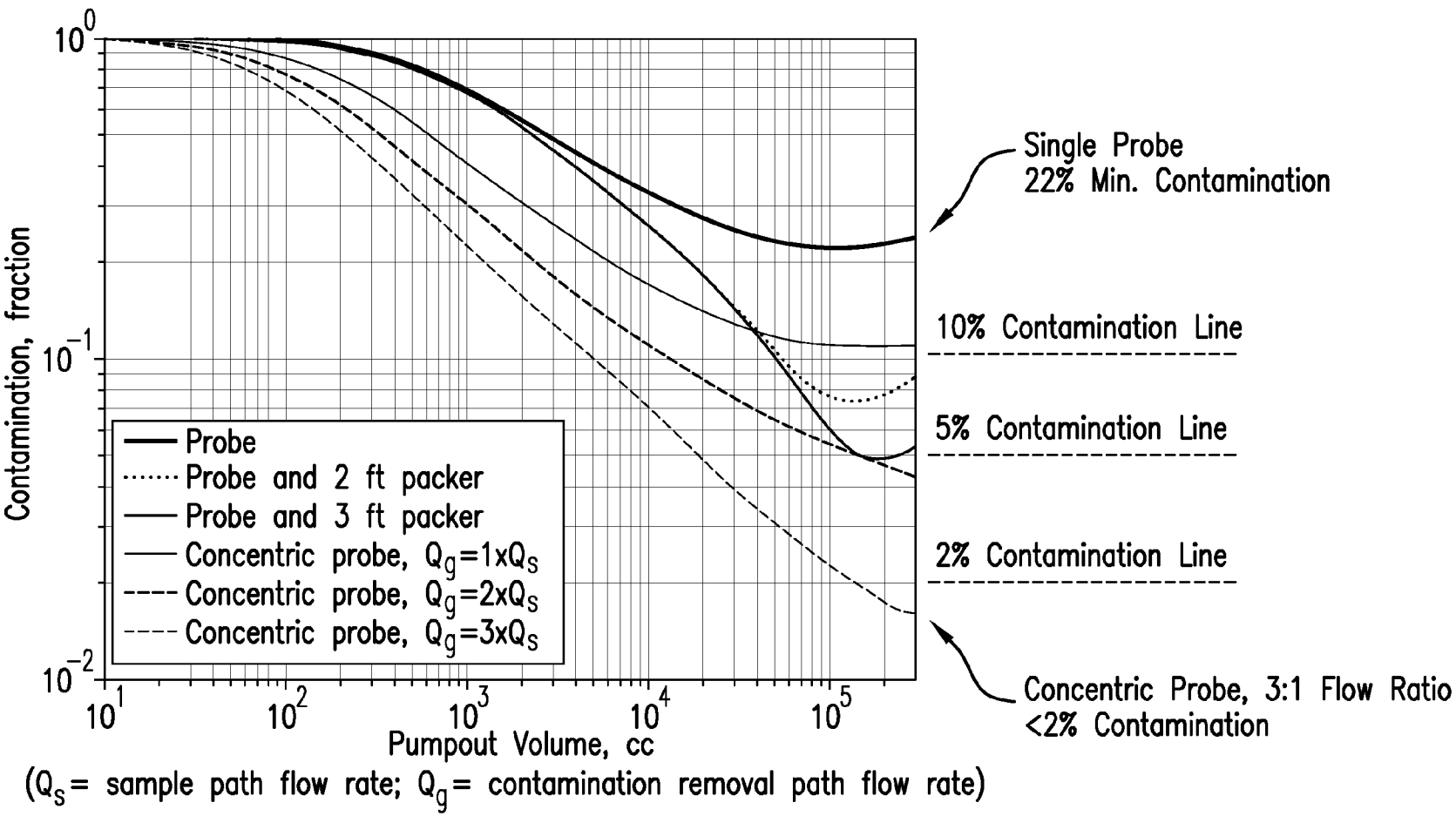
FIG. 3 illustrates a graph depicting aspects of an amount of formation fluid required to be extracted from the earth formation to achieve various levels of contamination.

Experiment, modeling, and analysis was used to determine the contamination removal performance of the embodiment depicted in FIGS. 1 and 2. Reference may now be had to FIG. 3, which illustrates a graph depicting aspects of various levels of contamination of an extracted formation fluid as a function of an amount of formation fluid extracted from the earth formation for different ratios of the sample flow rate to the contamination removal flow rate. Note that as the contamination removal flow rate increases with respect to sample flow rate, the total amount of fluid flow required to obtain a desired amount of contamination in the sample flow path 14 decreases and, thus, an amount of sample acquisition time also decreases.

Figure 4:
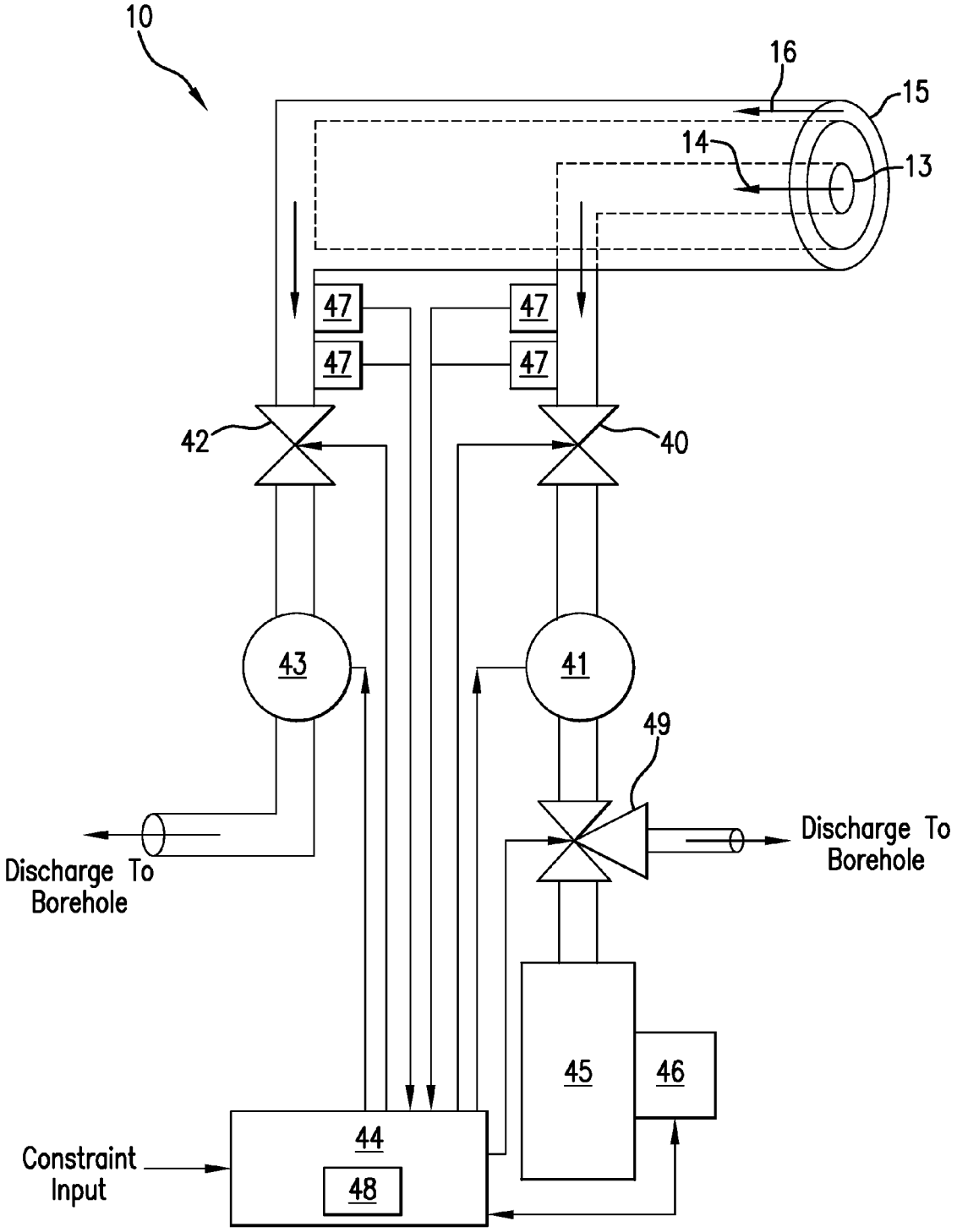
FIG. 4 depicts various aspects of the formation testing tool for improving a formation sample acquisition time.

Reference may now be had to FIG. 4 depicting aspects of the formation testing tool 10 in more detail. Coupled to the sample flow element 13 are a sample flow control valve 40 and sample flow pump 41. Similarly, coupled to the contamination removal flow element 15 are a contamination removal flow control valve 42 and a contamination removal flow pump 43. A controller 44 is coupled to each of the flow control valves 40 and 42 and each of the flow pumps 41 and 43. The controller 44 is configured to control the sample flow rate by modulating or adjusting the sample flow control valve 40, speed of the sample flow pump 41, or a combination thereof. Similarly, the controller 44 is configured to control the contamination removal flow rate by modulating or adjusting the contamination removal flow control valve 42, speed of the contamination removal flow pump 43, or a combination thereof.

Still referring to FIG. 4, the sample flow element 13 discharges either into the borehole 2 when contamination exceeds a certain threshold value or into a sample container 45 when the contamination is less than or equal to the threshold value using a three-way valve 49. In one or more embodiments, other types of valves may be used in place of or in addition to the three-way valve 49. Contamination threshold values can be input to the controller 44 by the downhole electronics 7 and/or the surface computer processing system 8. Isolation valves (not shown) can be used to isolate a sample of the formation fluid in the sample container 45. The sample container 45 can be removed from the formation testing tool 10 for analysis of its contents in a laboratory. Alternatively, a chemical analysis of the contents can be performed in the formation testing tool 10 using a chemical analyzer 46. In one embodiment, the chemical analyzer 46 is an optical spectrometer that optically interacts with the contents of the sample container 45 via one or more windows in the sample container 45. Non-limiting examples of types of optical spectroscopy include transmissive absorption spectroscopy and reflective absorption spectroscopy.

Still referring to FIG. 4, the formation testing tool 10 includes one or more sensors 47 disposed to sense a characteristic or property of the formation fluid flowing in the sample flow path 14 and/or the contamination removal flow path 16. The one or more sensors 47 provide input to the controller 44. In general, the characteristic or property relates to an amount of contamination by the drilling fluid 9 in the formation fluid in those flow paths. In one embodiment, the sensor 47 is an acoustic sensor having a resonator such as a tuning fork disposed in the flow path of the formation fluid. The resonator resonates at a frequency that depends on the amount of contamination present in the sample of formation fluid retrieved. By measuring the resonant frequency, the amount of contamination in the formation fluid sample retrieved can be determined. In one embodiment, the sensor 47 is an optical sensor.

In one embodiment, the optical sensor is based on the Raman effect, which is the inelastic scattering of photons by molecules. In Raman scattering, the energies of the incident or pumped photons and the scattered photons are different. The energy of Raman scattered radiation can be less than the energy of incident radiation and have wavelengths longer than the incident photons (Stokes Lines) or the energy of the scattered radiation can be greater than the energies of the incident photons (anti-Stokes Lines) and have wavelengths shorter than the incident photons. Raman spectroscopy analyzes these Stokes and anti-Stokes lines. The spectral separation between the optical pump wavelength and the Raman scattered wavelengths form a spectral signature of the compound being analyzed. Oil-based mud filtrate often has a spectral signature due to the presence of olefins and esters, which do not naturally occur in crude oils. In this way, Raman spectroscopy can be used to calculate the percentage of oil based mud filtrate contamination of formation fluid samples (such as crude oil samples), as they are being collected downhole. A sample of formation fluid can continue to be withdrawn from the formation 4 and discarded into the borehole 2 until the contamination falls below a selected level, and then the clean sample can be diverted, using the three-way valve 45, into the sample container 45.

The one or more sensors 47 can also be used to measure a property of the formation fluid related to a constraint imposed upon the process of extracting the formation fluid from the formation 4. For example, a constraint can be the bubble point pressure of a formation fluid mixture that includes the formation fluid and the mud-filtrate contamination. The bubble point pressure is the lowest pressure at which a vapor will form from mixture. The pressure at which the formation fluid mixture is retrieved must be kept below the bubble point pressure in order to keep the formation fluid mixture from creating a vapor or flashing. Flashing of the formation fluid mixture can cause damage to the formation testing tool 10 and may prevent the sensors 47 from measuring contamination accurately. In one embodiment, the flow pumps 41 and 43 cause a pressure decrease in the sample flow path 14 and the contamination removal flow path 16, respectively, in order to extract the formation fluid from the formation 4. Hence, the controller 44 using pressure inputs from pressure sensors 47 monitoring pressure in each of the sample flow path 14 and the contamination flow path 16 can control the flow pumps 41 and 43 to insure the pressure decrease does not exceed the bubble point pressure of the formation fluid mixture. Data related to imposed constraints such as bubble point pressures can be input to the controller 44 by the downhole electronics 7 and/or the surface computer processing system 8.

In one embodiment, the controller 44 is a multiple input—multiple output (MIMO) controller. In one embodiment, the MIMO controller 44 is configured to provide proportional-integral-derivative (PID) control. In one embodiment, the MIMO controller 44 is configured to use artificial intelligence to determine control outputs. In one embodiment, the artificial intelligence controller 44 is configured to perturb one or more of the control outputs to learn how contamination in the sample flow path 14 as measured by the sensors 47 will respond. By learning how the system that includes the tool 10, the borehole 2, the drilling fluid 9, and the formation 4 responds to different control perturbations, the artificial intelligence controller can optimize the control outputs to minimize or decrease an amount of time required to extract a sample of the formation fluid having an acceptable amount of contamination. In one embodiment, the controller 44 includes a memory configured to store learned information. The memory can also be configured to store information related to the geometry and flow characteristics of the sample flow path 14 and the contamination removal flow path 16.

In one embodiment, the controller 44 calculates a change in an amount of contamination C in the formation fluid over an interval of time, which can be expressed as a first derivative of C over time (i.e., dC/dt). The controller 44 can thus control the sample flow rate and the contamination flow rate to maximize or attempt to maximize dC/dt as a negative value within any input constraints. Maintaining dC/dt as a large as possible negative value will result in decreasing an amount of time required to acquire a sample of the formation fluid having an acceptable amount of contamination.

When the sensors 47 are used to measure mud-filtrate contamination, the sensors generally measure a property of the contamination and infer the amount of contamination from the measured property. In order to accurately determine the amount of contamination in the formation fluid in the sample flow path 14, outputs from the sensors 47 measuring different properties can be input to a Kalman filter 48, as shown in FIG. 4, to reduce noise and other inaccuracies.

It can be appreciated that various flow control components, such as check valves and four-way valves, in addition to or in lieu of the flow control valves and three-way valve depicted in FIG. 4 may be included in the downhole tool 10 for performing various flow control functions in support of decreasing or optimizing an amount of time required to obtain a sample of a formation fluid with an acceptable level of mud-filtrate contamination.

Figure 5:
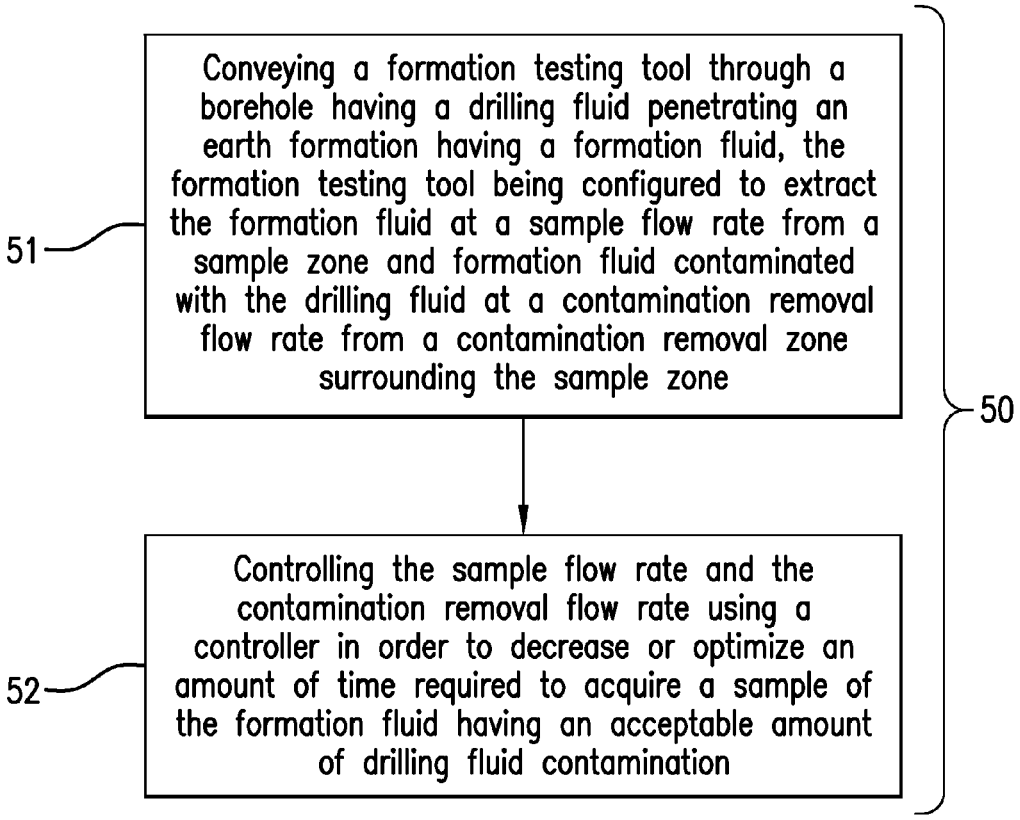
FIG. 5 presents one example of a method for extracting a sample of a formation fluid from within the borehole.

FIG. 5 presents one example of a method 50 for extracting formation fluid from an earth formation penetrated by a borehole having a drilling fluid. The method 50 calls for (step 51) conveying the formation testing tool 10 through the borehole 2. Further, the method 50 calls for (step 52) controlling the sample flow rate and the contamination removal flow rate in the formation testing tool 10 using the controller 44 in order to decrease or optimize an amount of time required to acquire a sample of the formation fluid having an acceptable amount of contamination.

In support of the teachings herein, various analysis components may be used, including a digital and/or an analog system. For example, the downhole electronics 7, the surface computer processing system 8, the controller 44, or the Kalman filter 48 may include the digital and/or analog system. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, magnet, electromagnet, sensor, electrode, transmitter, receiver, transceiver, antenna, controller, optical unit, electrical unit or electromechanical unit may be included in support of the various aspects discussed herein or in support of other functions beyond this disclosure.

The term "carrier" as used herein means any device, device component, combination of devices, media and/or member that may be used to convey, house, support or otherwise facilitate the use of another device, device component, combination of devices, media and/or member. Other exemplary non-limiting carriers include drill strings of the coiled tube type, of the jointed pipe type and any combination or portion thereof. Other carrier examples include casing pipes, wirelines, wireline sondes, slickline sondes, drop shots, bottom-hole-assemblies, drill string inserts, modules, internal housings and substrate portions thereof.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order. The term "couple" relates to one device being directly coupled to another device or indirectly coupled via an intermediate device.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A formation testing tool for extracting formation fluid from an earth formation penetrated by a borehole having a drilling fluid, the tool comprising:

a sample flow element configured to extract formation fluid from the formation in a sample zone;

a sample zone seal forming a perimeter defining the sample zone;

a contamination removal flow element configured to extract formation fluid contaminated with the drilling fluid from a contamination removal zone in the formation;

a contamination removal zone seal forming a perimeter defining the contamination removal zone, which surrounds and excludes the sample zone;

one or more sensors configured to measure a property of the formation fluid extracted by the sample flow element and/or the contamination flow element;

a sample flow control device configured to control flow of extracted formation fluid from the sample flow element;

a contamination removal flow control device configured to control flow of extracted formation fluid contaminated with the drilling fluid from the contamination removal flow element; and a controller comprising an input and an output and being configured to: (i) receive input from the one or more sensors; (ii) receive as input a first amount of contamination in the formation fluid extracted by the sample flow element; (iii) receive as input a constraint related to extracting the formation fluid using at least one of the sample flow element and the contamination removal flow element and to control at least one of the sample flow rate and the contamination removal flow rate to be within the constraint; (iv) calculate a first derivative of the first amount of contamination over time; and (v) provide a control output to control a sample flow rate in the sample flow element by modulating or adjusting the sample flow control device and a contamination removal flow rate in the contamination flow removal element by modulating or adjusting the contamination removal flow control device according to a calculation of a change in an amount of contamination in extracted formation fluid over an interval of time in order to decrease an amount of time required to acquire a sample of the formation fluid having an acceptable amount of contamination;

wherein the controller is further configured to control the sample flow rate and the contamination flow rate to maximize the first derivative of the first amount of contamination over time as a negative value within the constraint.

2. The tool according to claim 1, further comprising a sample container configured to contain a sample of the formation fluid having the acceptable amount of contamination.

3. The tool according to claim 2, further comprising an analysis device configured to analyze the formation fluid in the sample chamber.

4. The tool according to claim 1, wherein the one or more sensors are configured to measure an amount of contamination in the formation fluid extracted by the sample flow element and/or the contamination flow element.

5. The tool according to claim 1, wherein the one or more sensors are configured to measure pressure.

6. The tool according to claim 1, wherein the constraint is a bubble point pressure of the formation fluid contaminated with the drilling fluid.

7. The tool according to claim 1, wherein the controller comprises a first output configured to control the sample flow rate and a second output configured to control the contamination removal flow rate.

8. The tool according to claim 7, wherein the first output controls at least one of a flow pump and a flow control valve associated with the sample flow element and the second output controls at least one of a flow pump and a flow control valve associated with the contamination removal flow element.

9. The tool according to claim 8, wherein the controller further comprises a first input configured to be coupled to a first sensor that measures an amount of contamination in the formation fluid extracted by the sample flow element and a second input configured to be coupled to a second sensor that measures a parameter associated with a constraint.

10. The tool according to claim 1, further comprising a Kalman filter configured to reduce noise and/or inaccuracies of inputs from sensors.

11. The tool according to claim 1, wherein the tool is configured to be conveyed through the borehole by one of a wireline, a slickline, a drill string, or coiled tubing.

12. The tool according to claim 1, wherein the sample flow rate is controlled by controlling a pressure in the sample flow element or the contamination removal flow rate is controlled by controlling a pressure in the contamination removal flow element.

13. A method for extracting formation fluid from an earth formation penetrated by a borehole having a drilling fluid, the method comprising:

conveying a formation testing tool through the borehole, the tool comprising:

a sample flow element configured to extract formation fluid from the formation in a sample zone; a sample zone seal forming a perimeter defining the sample zone; a contamination removal flow element configured to extract formation fluid contaminated with the drilling fluid from a contamination removal zone in the formation; a contamination removal zone seal forming a perimeter defining the contamination removal zone, which surrounds and excludes the sample zone; one or more sensors configured to measure a property of the formation fluid extracted by the sample flow element and/or the contamination flow element; a sample flow control device configured to control flow of extracted formation fluid from the sample flow element; a contamination removal flow control device configured to control flow of extracted formation fluid contaminated with the drilling fluid from the contamination removal flow element; and a controller comprising an input and an output and being configured to: (i) receive input from the one or more sensors and (ii) provide a control output to control a sample flow rate in the sample flow element by modulating or adjusting the sample flow control device and a contamination removal flow rate in the contamination flow removal element by modulating or adjusting the contamination removal flow control device according to a calculation of a change in an amount of contamination in extracted formation fluid over an interval of time;

controlling the sample flow rate and the contamination removal flow rate according to the calculation in order to decrease an amount of time required to acquire a sample of the formation fluid having an acceptable amount of contamination using the controller;

receiving as input to the controller an amount of contamination in the formation fluid extracted by the sample flow element as measured by a sensor;

receiving as input to the controller a sensor measurement of a parameter related to a constraint imposed on at least one of the sample flow rate and the contamination removal flow rate;

calculating a first derivative of the first amount of contamination over time; and controlling the sample flow rate and the contamination flow rate to maximize the first derivative of the first amount of contamination over time as a negative value within the constraint.

14. The method according to claim 13, wherein controlling the sample flow rate and the contamination flow rate comprises controlling a pressure in the sample flow element or a pressure in the contamination removal flow element.

15. A non-transitory computer-readable medium comprising computer-executable instructions for extracting formation fluid from an earth formation penetrated by a borehole having a drilling fluid by implementing a method comprising:

controlling a sample flow rate;

controlling a contamination removal flow rate in order to decrease an amount of time required to acquire a sample of the formation fluid having an acceptable amount of contamination using a formation testing tool comprising:

a sample flow element configured to extract formation fluid from the formation in a sample zone; a sample zone seal forming a perimeter defining the sample zone; a contamination removal flow element configured to extract formation fluid contaminated with the drilling fluid from a contamination removal zone in the formation; a contamination removal zone seal forming a perimeter defining the contamination removal zone, which surrounds and excludes the sample zone; one or more sensors configured to measure a property of the formation fluid extracted by the sample flow element and/or the contamination flow element; a sample flow control device configured to control flow of extracted formation fluid from the sample flow element; a contamination removal flow control device configured to control flow of extracted formation fluid contaminated with the drilling fluid from the contamination removal flow element; and a controller comprising an input and an output and being configured to: (i) receive input from the one or more sensors and (ii) provide a control output to control the sample flow rate in the sample flow element by modulating or adjusting the sample flow control device and the contamination removal flow rate in the contamination flow removal element by modulating or adjusting the contamination removal flow control device according to a calculation of a change in an amount of contamination in extracted formation fluid over an interval of time;

receiving as input to the controller an amount of contamination in the formation fluid extracted by the sample flow element as measured by a sensor;

receiving as input to the controller a sensor measurement of a parameter related to a constraint imposed on at least one of the sample flow rate and the contamination removal flow rate;

calculating a first derivative of the first amount of contamination over time; and controlling the sample flow rate and the contamination flow rate to maximize the first derivative of the first amount of contamination over time as a negative value within the constraint.

16. The non-transitory computer-readable medium according to claim 15, wherein controlling the sample flow rate and the contamination flow rate comprises controlling a pressure in the sample flow element or a pressure in the contamination removal flow element.

* * * * *